United States Patent [19]

Gaudino

[11] Patent Number: 4,569,191

[45] Date of Patent: Feb. 11, 1986

[54] RING SPINNING OR TWISTING MACHINE HAVING AN AUTOMATIC COP-REMOVAL DEVICE

[75] Inventor: Piero Gaudino, Cossato, Italy

[73] Assignee: Officine Gaudino di P. Gaudino & C.S. A.S., Italy

[21] Appl. No.: 561,074

[22] Filed: Dec. 14, 1983

[30] Foreign Application Priority Data

Dec. 17, 1982 [IT] Italy ..... 68482 A/82

[51] Int. Cl.[4] ..... D01H 9/00

[52] U.S. Cl. ..... 57/276; 57/273; 57/274

[58] Field of Search ..... 57/266, 270, 273, 274, 57/276

[56] References Cited

U.S. PATENT DOCUMENTS

| | | | |
|---|---|---|---|
| 2,582,696 | 1/1952 | Haythornthwaite | 57/273 |
| 2,661,589 | 12/1953 | Haythornthwaite | 57/276 |
| 3,466,863 | 9/1969 | Wachendorf | 57/273 |
| 3,678,672 | 7/1972 | Brissey et al. | 57/273 |
| 3,962,856 | 6/1976 | Weller et al. | 57/273 |
| 4,233,810 | 11/1980 | Kamp | 57/273 X |

FOREIGN PATENT DOCUMENTS

| | | |
|---|---|---|
| 857173 | 11/1952 | Fed. Rep. of Germany . |
| 2156087 | 5/1973 | France . |
| 2236036 | 1/1975 | France . |
| 684700 | 12/1952 | United Kingdom . |

*Primary Examiner*—John Petrakes

*Attorney, Agent, or Firm*—Barnes & Thornburg

[57] ABSTRACT

In a widely-used type of ring, spinning or twisting machine, each spindle of the machine is provided at its upper end with a spinning head. This head is engaged by yarn to be wound onto a cop spool carried on the spindle, the yarn passing from the spinning head to the ring traveller associated with that spindle. Due to the engagement of the yarn with the spinning head it is generally not possible to employ known types of automatic cop removal device with such machines. To overcome this problem, cop-raising means are provided which, at the end of each cop-forming process and prior to operation of the cop-removal device, serve to raise the cop spools above the level of the upper ends of the spinning heads whereby to disengage the yarns therefrom. The cop-raising means comprise, for example, a mechanism arranged to displace upwardly the so-called ring nuts associated with each spindle.

13 Claims, 2 Drawing Figures

RING SPINNING OR TWISTING MACHINE HAVING AN AUTOMATIC COP-REMOVAL DEVICE

Figure 1:
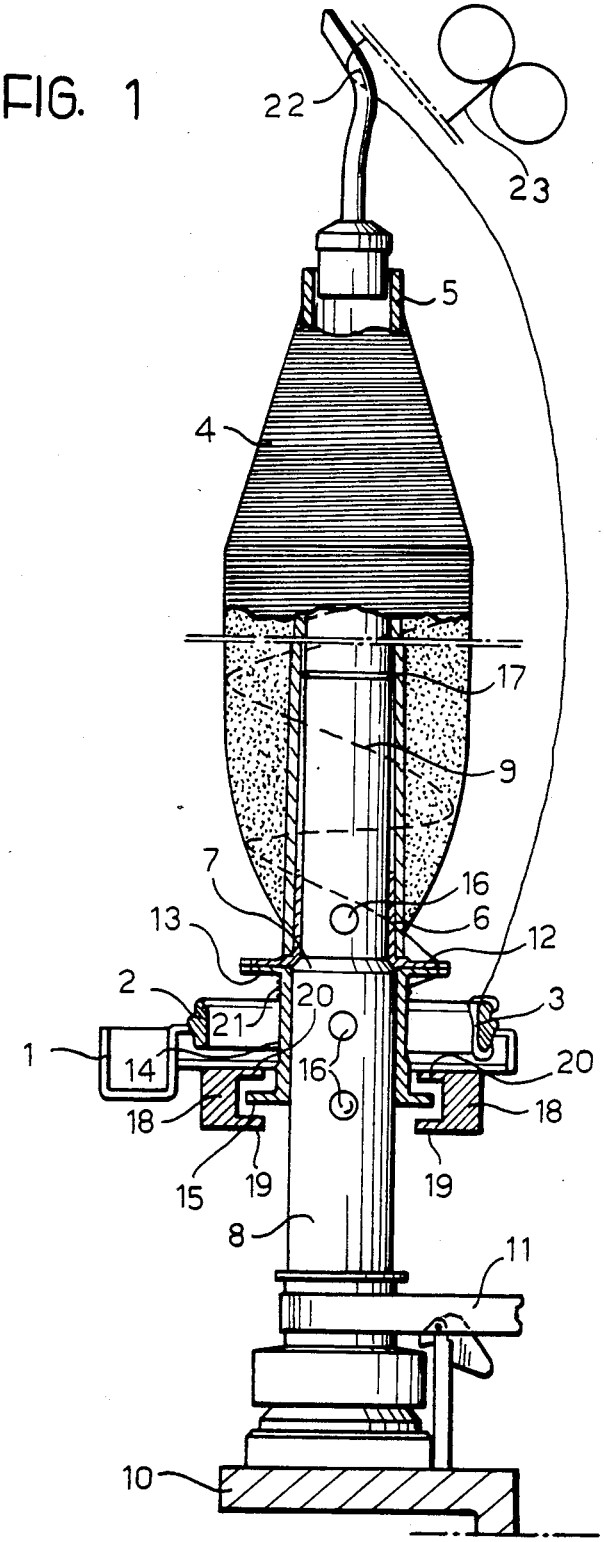

The present invention relates to improvements in ring spinning or twisting machines having devices for automatically removing full cops and replacing them by empty cop spools, and in particular to spinning or twisting machines incorporating automatic removal devices arranged to carry out the removal of all full cops simultaneously.

The said devices of known type have take-up members which, at the end of each cop-forming process, grasp the full cops and remove them from the spindles by displacing them upwardly. These devices do not however lend themselves to use in ring spinning or twisting machines of the type at present widely used in which each spindle carries at its upper end a so-called spinning head that is engaged by the yarn leaving the overlying feeding device or drafting assembly before passing to the traveller of the ring mounted on the ring carrier platform carriage.

In this latter case, the operation of removing the full cops and replacing them with empty cop spools must, as before, be carried out by hand in a long manual process thus causing frequent and not inconsiderable stoppages of the machine which, as will be appreciated, is unfavourable with regards to production costs. The object of the present invention is to avoid this disadvantage and to provide a ring spinning or twisting machine having a device incorporated therein for automatically removing full cops and replacing them with empty cop spools, which is capable of use even in the case in which the spinning or twisting machine is of the type having spindles provided with spinning heads at their upper ends.

According to the present invention, this object is achieved by the provision of a ring spinning or twisting machine incorporating a device for automatically removing all of the cops simultaneously, the machine being characterised in that it has means separate from the automatic removal device which are arranged at the end of each cop-forming process, to raise the cops from the positions which they occupy during the winding of the yarns on the respective cop spools and prior to the cops being grasped by the take-up members of the automatic removal device, to a height at which the tops of the cop spools are located above the level of the upper ends of the spinning heads located on top of the spindles.

According to a preferred embodiment of the invention, the simultaneous upward movement of the cops is effected by the exertion of an upward thrust on the so-called upper sleeves on which the cop spools are fitted as a result of the displacement in the same direction of the lower ring nuts on which fastening turns are wound at the end of the cop-forming process; this upward displacement may be preceded by a preliminary downward displacement of the lower sleeve in order to snap the yarns at sections between the peripheral toothing of the sleeve parts that are in the form of annular discs and are normally together.

Figure 2:
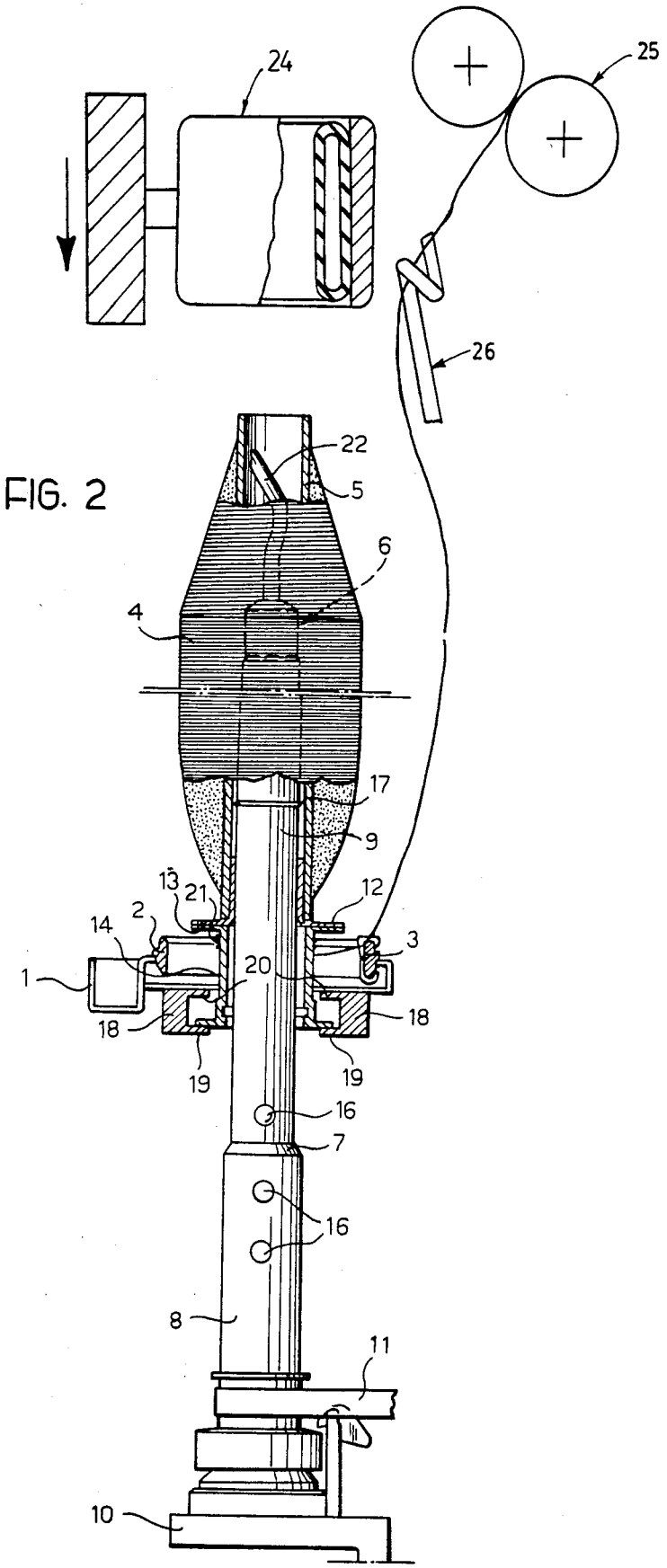

Other characteristics and advantages of the invention will emerge from the description which follows with reference, purely by way of non-limiting example, to one practical embodiment illustrated in the appended drawings, in which:

FIG. 1 is a partially sectioned, side elevational view of one of the spindles of a spinning or twisting machine according to the invention at the end of a cop-forming process, FIG. 2 is a similar view showing the same spindle in another operative phase of the machine.

In the drawings, the ring carrier platform is indicated 1 and one of the rings and its associated traveller are indicated 2 and 3, these being the parts whose reciprocating vertical movement leads to the formation of a cop 4 by the yarn wound on the cop spool 5. This latter is fitted onto the tubular part 6 of the so-called upper sleeve which normally rests on the radial frusto-conical shoulder 7 formed between the lower, larger diameter part 8 and the smaller diameter part 9 of a spindle of the machine, the spindle being part of a row of spindles that are rotatably supported on the front table support 10 and are arrranged to be rotated by means of belts 11 from drive means not illustrated.

The lower part of the upper sleeve has an annular disc 12 with peripheral toothing and is juxtaposed a similar disc 13 formed at the top of a tubular body 14 of the lower ring nut engaged about the larger diameter section 8 of the spindle and terminated at its lower end by a radial flange 15. Blocks 16 of resilient material are inserted in radial holes, preferably through-holes, formed in the spindle and render the upper and lower sleeve fast for rotation with their respective spindles.

The upper sleeve is displaceable upwardly from its normal position illustrated in FIG. 1, up to a stop constituted by an expandable ring 17 seated in an annular peripheral groove formed in the part 9 of the spindle.

The lower sleeve 13, 14 and 15 is movable vertically under the action of a device constituted by two bars 18 located on opposite sides of the row of spindles and provided with lower lugs 19 and upper lugs 20 arranged to engage the annular flange 15 of the lower sleeve.

Vertical movements of the bars 18 are effected by motor means which may be of mechanical, hydraulic, pneumatic, electrical or magnetic type and are synchronised with the drives used to implement the operative cycle of the machine and of the corresponding automatic removal device.

The operation of the structure described above is as follows.

At the end of a so-called cop-forming process, the parts occupy the positions illustrated in FIG. 1. In this position, the ring carrier platform is located in the so-called "under-spool" position and the spindle 8, 9 continues to rotate for a predetermined time so as to wind several fastening turns 21 on the central tubular body 14 of the lower sleeve by means of the ring 2 and traveller 3, the lower sleeve being held in the desired axial position by the blocks or pins 16.

When the turns 21 have been wound on, the spindle 8, 9 is stopped and the device constituted by the bars 18 is started. This device moves upwardly and its lugs 19 engage the lower radial flange 15 of the lower sleeve from below. This causes a simultaneous upward movement of the lower and upper sleeves, removing the latter from the frusto-conical radial shoulder 7 and raising the cop spool and the cop 4 wound thereon.

This movement which results in a similar movement of the ring carrier platform 1, ends when the top of the cop spool 5 is located at a level above that occupied by the free end of the spinning head 22 whereby to disengage therefrom the yarn 23 which leaves the drafting assembly or feed device 25 and passes through the guide eye. The guide eye 26 in this phase of operation of the machine, is raised and displaced laterally relative to the axis of the spindle carrying the cop 4.

The cop is thus completely free and may be grasped by the take-up members 24 of the device, for automatic take-up and upward removal without the danger of the take-up member interfering with the yarn 23 and breaking it with the consequent need to stop the machine.

Naturally, the principle of the invention remaining the same, the details may be varied widely with respect to those described and illustrated purely by way of example, without thereby departing from the scope of the present invention as defined in the appended claims.

Thus for example, the stage of raising the sleeves towards the position in which the top of the cop spool 5 is located at a level above the free end of the spinning head 22, may be preceded by a downward movement of the lower sleeve, under the action of a force exerted on its lower flange by the lugs 20 of the bars 18 (which in this phase would be given a downward vertical movement). This lowering would then conveniently be followed by upward movement beyond the normal starting position in the manner specified above.

I claim:

1. A ring spinning machine comprising:

at least one spindle for receiving a cop spool upon which yarn is formed;

a spinning head disposed on the end of the spindle;

cop removal device means for removing cop spools with yarn formed thereon;

a cop raising means for raising the cops to a position so that at least the tops of the cop are above the spinning heads to accommodate removal of the cop spools by the cop removal device means.

2. A ring spinning machine as in claim 1, wherein said spinning head engages yarn during a cop forming process.

3. A ring spinning machine as in claim 2, wherein said spinning head is free of yarn prior to cop removal.

4. A ring spinning machine as in claim 3, wherein said cop raising means disengages yarn from said spinning head.

5. A ring spinning machine as in claim 4, including at least one sleeve received on said spindle, said sleeve having a top and bottom end, said sleeve engaging a cop spool placed on said spindle.

6. A ring spinning machine as in claim 5, wherein said sleeve has a tubular section surrounding said spindle and an integral lower annular disc on the bottom of said tubular section.

7. A ring spinning machine as in claim 6, wherein the cop raising means comprises two bars on opposite sides of said spindles, said bars having upper and lower lugs, in between which is disposed said bottom annular disc of said sleeve, wherein said lugs engage said lower sleeve for raising and lowering said sleeve.

8. A ring spinning machine as in claim 7, wherein the operation of the raising means is automatic.

9. A ring spinning machine as in claim 8, wherein there is an upper sleeve and a lower sleeve, each having top and bottom ends, said upper sleeve having an integral annular disc on the bottom, and said lower sleeve having an upper integral annular disc on top and a lower annular disc on bottom.

10. A ring spinning machine as in claim 9, wherein the cop raising means engages the lower annular disc of said lower sleeve, the upper sleeve engages the cop, and the cop raising means raises the lower sleeve into the upper sleeve thereby forcing the cop spool upward.

11. A ring spinning machine as in claim 10, wherein said cop raising means raises the cops above the spinning head thereby disengaging the yarn.

12. A ring spinning machine as in claim 11, wherein the cop removal means are grippers.

13. A ring spinning machine as in claim 12, wherein there is a row of spindles and said raising means comprises two bars which engage the lower sleeves of said spindles.

* * * * *

UNITED STATES PATENT AND TRADEMARK OFFICE

CERTIFICATE OF CORRECTION

PATENT NO. : 4,569,191

DATED : February 11, 1986

INVENTOR(S) : Piero Gaudino

It is certified that error appears in the above-identified patent and that said Letters Patent is hereby corrected as shown below:

Column 4, line 14, change ", said" to --. Said--

Signed and Sealed this

*Twenty-second* Day of *July 1986*

[SEAL]

*Attest:*

DONALD J. QUIGG

*Attesting Officer*

*Commissioner of Patents and Trademarks*